United States Patent [19]

Melfi

[11] Patent Number: 4,921,204

[45] Date of Patent: May 1, 1990

[54] ADJUSTABLE MEDIAN BARRIER MOLD

[75] Inventor: Nicholas W. Melfi, Manlius, N.Y.

[73] Assignee: Concrete Pipe & Products Corp., E. Syracuse, N.Y.

[21] Appl. No.: 315,905

[22] Filed: Feb. 27, 1989

[51] Int. Cl.[5] ..... B28B 7/02

[52] U.S. Cl. ..... 249/2; 249/155; 249/158; 249/159; 404/98; 425/63

[58] Field of Search ..... 249/2, 50, 155, 157, 249/158, 159; 404/98; 425/63, 64, DIG. 25

[56] References Cited

U.S. PATENT DOCUMENTS

| | | | |
|---|---|---|---|
| Re. 32,936 | 5/1989 | Smith | 249/157 X |
| 2,610,381 | 9/1952 | Rosati et al. | 249/2 |
| 3,009,229 | 11/1961 | Tumey | 249/50 |
| 3,071,833 | 1/1963 | Tumey | 249/50 |
| 3,071,835 | 1/1963 | Tumey | 249/155 X |
| 3,132,403 | 5/1964 | Richards et al. | 249/158 X |
| 3,428,287 | 2/1969 | Redding et al. | 425/63 X |
| 3,544,058 | 12/1970 | Lohman | 249/158 |
| 3,792,133 | 2/1974 | Goughnour | 425/64 X |
| 4,014,633 | 3/1977 | Goughnour | 425/63 |
| 4,533,111 | 8/1985 | Cousin et al. | 249/2 |
| 4,668,462 | 5/1987 | Smith | 264/320 |

*Primary Examiner*—Richard L. Chiesa
*Attorney, Agent, or Firm*—Wall and Roehrig

[57] ABSTRACT

A fixture for an adjustable mold in which concrete road barrier sections are precast. The mold can be configured to cast symmetrical or asymmetrical sections having a uniform cross section throughout or a cross section that varies uniformly along the length of the section.

8 Claims, 6 Drawing Sheets

ADJUSTABLE MEDIAN BARRIER MOLD

BACKGROUND OF THE INVENTION

This invention relates to an adjustable mold for casting concrete median barriers and, in particular, to an adjustable mold for precasting median barriers of varying sizes and shapes so that they conform to the actual topography of the road.

As explained in U.S. Pat. No. 4,668,462 to Smith, concrete median barriers have a particular geometry that is designed to minimize the risks to motorists in the event the barrier is struck by a moving vehicle. When the roadway is level, the barrier will be symmetrical, that is, it will have the same profile on the opposing faces of the side walls. Vehicles striking the barrier on either side will be deflected away from the barrier and thus prevented from entering an adjacent lane of traffic. Actual road beds, however, are generally not level and the lanes sometimes converge and diverge in relation to each other. Consequently, the requirements for concrete median barriers at the job site may vary considerably to meet changing road geometries.

One way to fabricate an asymmetrical median barrier is to build a specific or dedicated mold at the job site. After the median section is cast, the mold is generally broken down and the parts discarded. Casting methods using dedicated molds have proven to be both time consuming and extremely expensive.

Attempts have been made to build adjustable metal molds for use at the job site to cast barriers in place. This type of mold is disclosed in U.S. Pat. Nos. 3,792,133 and 4,014,633. These molds generally have at least one adjustable sidewall that provides for limited changes in the profile of the cast section.

Smith, in the previously noted 4,668,462 Pat. provides a reusable mold fixture in which asymmetrical road median sections can be cast. The mold has one fixed sidewall of a desired contour and an opposing adjustable sidewall having a similar contour. The adjustable sidewall is movably mounted in the fixture so that it can be selectively positioned in a vertical plane. Smith utilizes very special split end wall doors to close his mold.

The Smith mold, when set up in the field, operates well when casting asymmetrical barrier sections. The end wall doors, however, are difficult to adjust and align with the side walls of the mold. The mold furthermore can not be adjusted to change the width of the barrier sections. Oftentimes the distance between adjacent road lanes, as well as the elevation of the lane surfaces, will change, and it is desirable to not only alter the sidewall profile of a barrier, but also the width of the section along its length.

OBJECTS AND SUMMARY OF THE INVENTION

It is therefore an object of the present invention to improve permanent molds used to prefabricate median barrier sections at an existing job site.

It is a further object of the present invention to provide a form for casting concrete median barrier sections that can be adjusted to vary the elevation profile of one side wall of the mold with respect to the opposing side wall, while at the same time uniformly varying the width of the molded section along its length.

A still further object of the present invention is to provide a mold for casting concrete median barrier sections wherein the bottom wall of the mold has a fixed section and a removable section that can be replaced in assembly to change the geometry of the molding cavity.

These and other objects of the present invention are attained by means of an adjustable mold for casting either symmetrical or asymmetrical concrete road barrier sections that includes a fixture containing a base upon which is mounted a vertically extended stationary frame for rigidly supporting one side wall of the mold. The bottom wall of the mold includes a fixed panel secured to the stationary frame and a removable panel that can be replaced in assembly to alter the geometry of the mold. The opposing side wall of the mold is adjustably supported in a movable frame slidably mounted in the base of the fixture. The adjustable side wall of the mold can be either vertically aligned with respect to the stationary side wall and/or angularly offset therewith to vary the width of the mold along its length. The ends of the mold are closed using simple end doors that are bolted in place against the fixed and movable frames.

BRIEF DESCRIPTION OF THE DRAWINGS

For a better understanding of these and other objects of the present invention, reference will be made to the following detailed description of the invention which is to be read in conjunction with the associated drawings, wherein.

DESCRIPTION OF THE INVENTION

Figure 10:
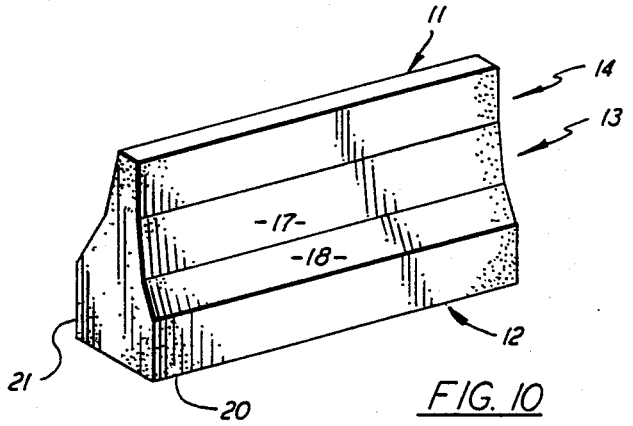
FIG. 10 is a perspective view showing a typical concrete road barrier section of the type cast in the present mold.

Referring now to the drawings, there is shown a fixture generally referenced 10, that supports an adjustable mold in which concrete median barrier sections 11 of the type shown in FIG. 10 are cast. This type of barrier section typically contains a rectangular base section 12, a center section 13 having a pair of opposed inwardly sloping side walls for connecting the base section to a thinner crown section 14. The sloping sidewalls of the center section may have one or more planar faces, as for example faces 17 and 18. When the barrier is set in place, the parallel side walls 20 and 2 of the base section must protrude upwardly some distance above the road surface to enhance the barrier to properly engage a motor vehicle. When the barrier is mounted between traffic lanes that are at the same elevation, the vertical side walls 20 and 21 of the base section will be cast to the same height and the sloping side walls of the barrier will be symmetrical. In the event the adjacent road lanes are at different elevations, the base side walls 20 and 21 will be cast to different heights to compensate for the change in elevation. At the same time, the relative position of the sloping faces are changed commensurate with the change in the base whereby the sloping faces of the barrier are no longer symmetrical. Oftentimes, the adjacent traffic lanes are not only at different elevations, but they also diverge or converge slightly to follow the terrain. Accordingly, it is desirous to not only vary the side wall profile of a barrier section, but also the width of the section along its length.

The present mold fixture can be adjusted so that a standard sized symmetrical barrier, having uniform cross section, can be cast therein. In addition, the mold can be adjusted to produce an asymmetrical barrier section having a uniform width along its length or, alternatively, a width that varies from one end of the section toward the other end. As illustrated in FIGS. 1-4, the mold supporting fixture 10 includes a base 24 formed of structural members that are welded together to form a grid. An upright stationary frame 25, also formed of structural members, is securely affixed to the base so that the stationary frame is disposed longitudinally from the front to the back of the base. A movable frame 26 is also mounted in an upright position in the base opposite the stationary frame so that it can move toward and away from the stationary frame.

one side wall 28 of the mold supported in the fixture is securely affixed to the stationary frame. Side wall 28 faces the opposing side wall 29 of the mold which, as noted, is adjustably mounted in the movable frame. The adjustable side wall can be moved vertically in the frame and into an infinite number of positions between an extreme raised position and an extreme lower position. The movable side wall has an extended skirt **29*a* that is arranged to ride in sliding contact with the bottom wall 40 of the mold. In the present mold, the barrier will be cast in an inverted position with the wider base section being formed at the top of the mold to facilitate removal of the cast part through the open top of the mold. The side walls 28 and 29** are each formed from a single sheet of steel plate. The plates are bent into a desired profile which replicates the side wall configuration of the cast barrier section. The adjustable side wall can be positioned relative to the stationary side wall so that either symmetrical or asymmetrical barrier sections can be poured having either a uniform across section throughout, or one that varies along the length of the barrier section.

The base of the fixture contains a series of channel-shaped structural members that include two side members 30 and 31 and a plurality of parallel spaced apart longitudinal members 32—32. The structural members are welded together in assembly to form a box-like unit for supporting the stationary and movable frames in assembly. Stationary frame 25 includes a plurality of vertical columns 35—35 that are secured in an upright position as by welding the columns to the lateral members 32—32 of the base. Inclined brace members 37—37 are employed to connect the top section of each column, the base to rigidly hold the columns in assembly, and thus prevent the columns from moving. The stationary side wall 28 of the mold is securely affixed to the aligned columns of the side wall so that it extends across the entire length of the stationary frame. Although not shown, stiffening plates are welded to the back of the side wall to provide additional strength to the wall, and thus prevent the wall from buckling or otherwise deforming when concrete is poured into the mold.

A horizontal support beam 39 is secured to column 35 and beneath the bottom wall 40 of the mold. The extended end of each support beam 39 is welded to a short upright post 41 which, in turn, is welded to a joist 42 (FIG. 4) in the base 24.

Figure 4:
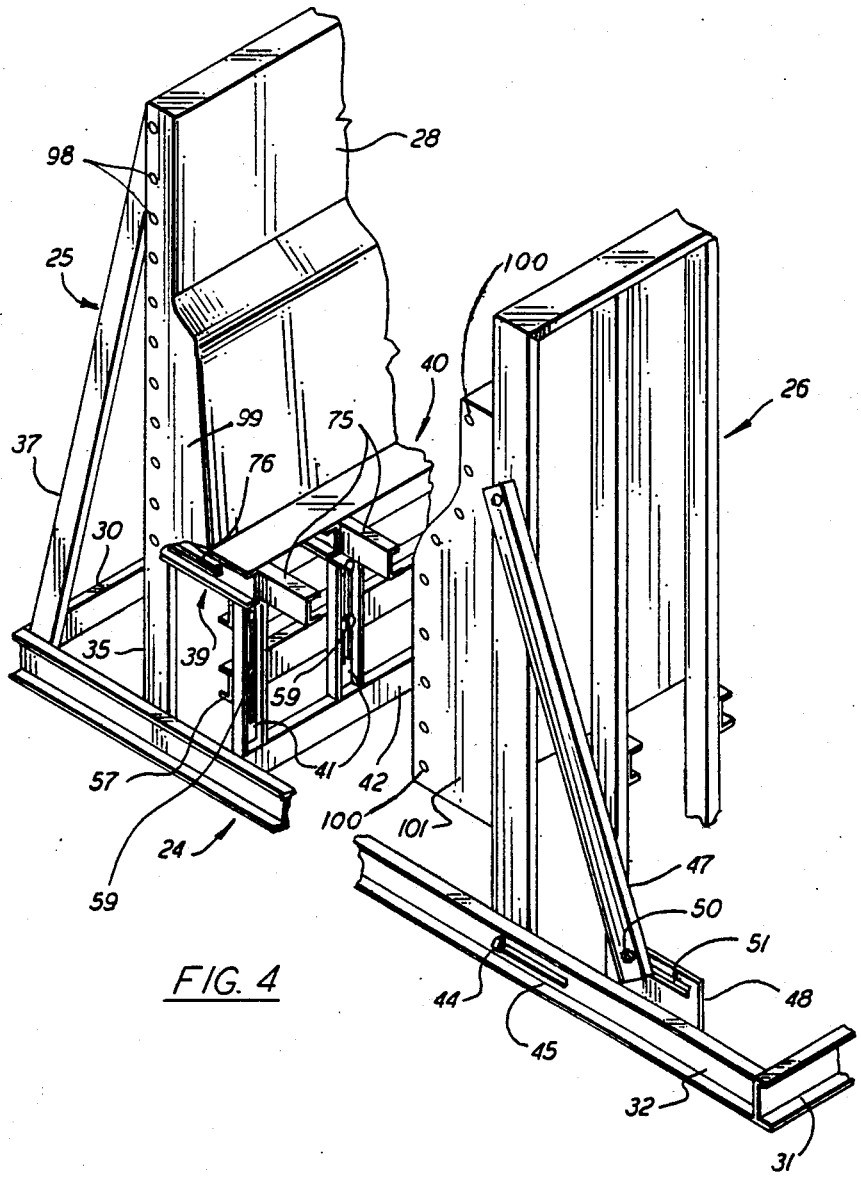
FIG. 4 is a partial end view in perspective, showing the present mold in an open position with one of the floor panels removed.

The movable frame 26 also contains a series of spaced apart upright columns 43—43 that are positioned inside and adjacent to lateral base members 32—32. Each column is connected to a lateral base member by means of a bolt 44. The bolt is carried within a horizontally aligned slotted hole 45 that passes through the lateral base member as shown in FIG. 4. By loosening the bolts in assembly, the columns 43—43 can be moved along a horizontal path of travel towards or away from the fixed frame 25. An inclined brace 47 is secured to the top part of each column. The bottom section of the brace is slidably supported within a raised plate 48 that is welded to one of the lateral brace members 32. A bolt 50 is carried in the lower end of the brace and is slidably received within a horizontally disposed slotted hole 51 formed in the plate members. Accordingly, the brace can move with the frame as it is being positioned in the fixture. A catwalk, generally referenced 52 is supported in the upper part of the movable frame to provide workmen ready access to the open top of the mold.

Figure 2:
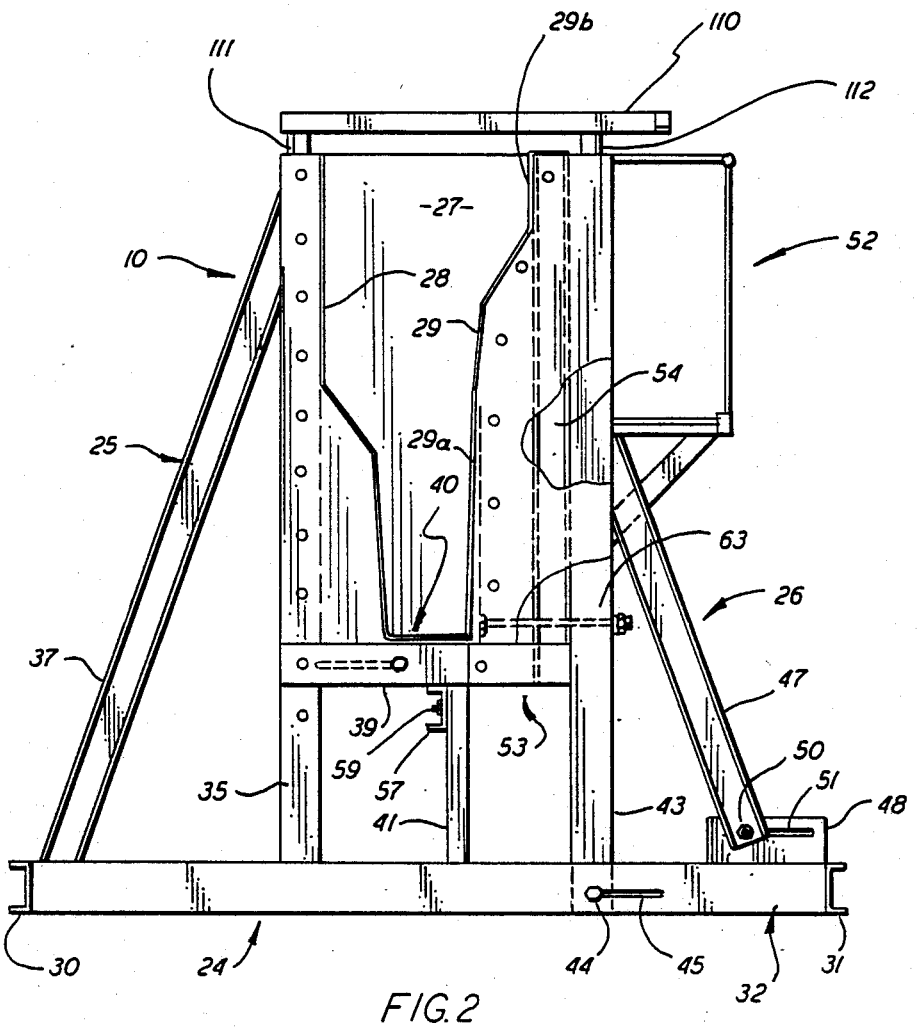
FIG. 2 is an enlarged end view of the fixture shown in FIG. 1.
Figure 3:
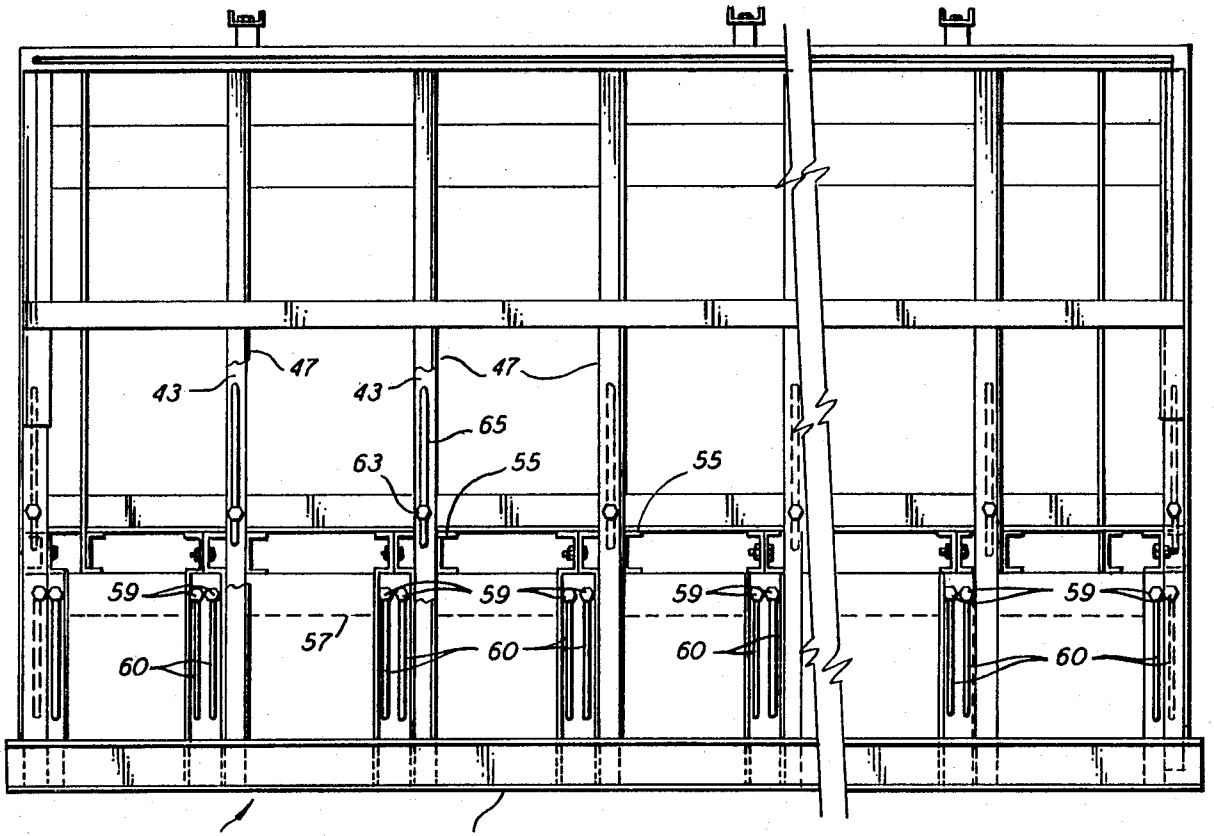
FIG. 3 is a side elevation of the fixture shown in FIG. 1.
Figure 5:
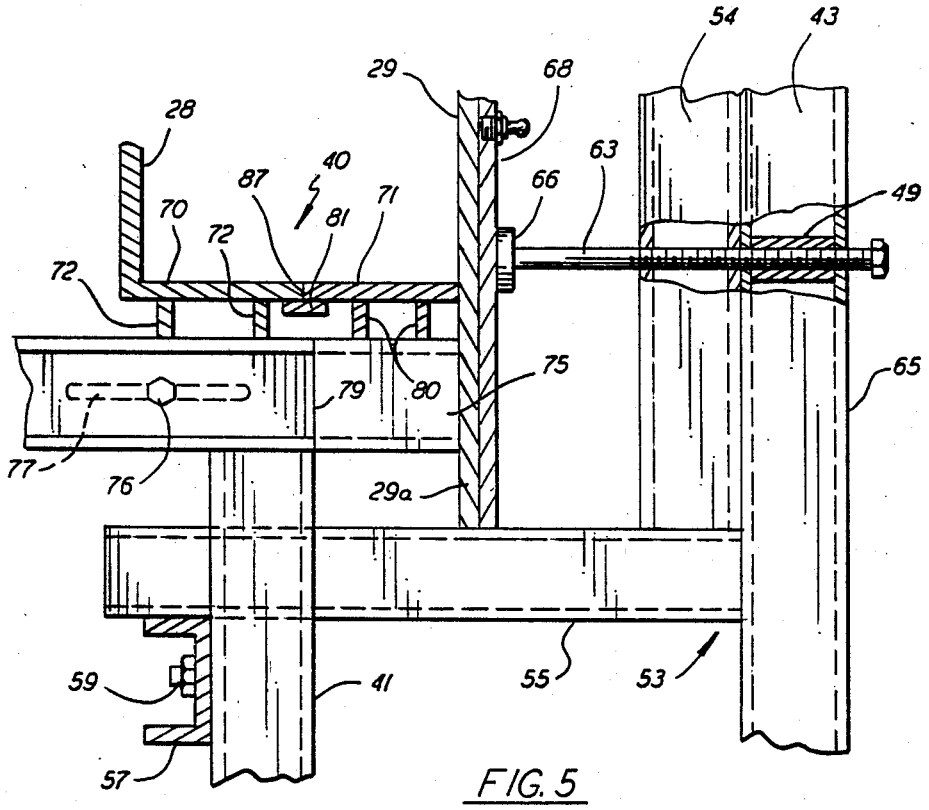
FIG. 5 is an enlarged partial view in section showing the bottom section of the mold with both floor panels in place.

With particular reference to FIGS. 2, 4 and 5, the adjustable side wall 29 of the mold is attached to a slide mechanism generally referenced 53 that is arranged to move vertically in sliding contact against the vertical columns 43—43. The slide mechanism includes a series of slide members 54—54 that are positioned in face-to-face contact with the inside face of the vertical columns. A horizontal cross member 55 is welded to the bottom of each slide member and is arranged to pass beneath the bottom wall 40 of the mold. Each cross member is further adapted to seat upon the top of an adjustable horizontally disposed rest 57. The adjustable rest is attached to the back side of the upright posts 41-41 by means of bolts 59-59. The bolts are carried in vertically disposed slotted holes 60-60 formed in the vertical posts 41. Loosening the bolts allows the rest to move within a vertical plane. The extent of vertical movement afforded the rest determines the amount of vertical movement afforded the adjustable wall 29. Tightening down the bolts 59—59 locks the rest against the posts 41—41 and thus securely positions the side wall 29 in the fixture A series of elongated positioning bolts 63—63 are contained within threaded sleeves 49 (FIG. 5) mounted in the vertical columns 43 of the movable frame. The shank of each positioning bolt passes through a vertical slot 65 (FIG. 3) formed in the slide member 54 of the side wall bracket 53. An expanded head 66 (FIG. 5) is carried upon the distal end of the shank. The head bears against a backing plate 68 that is welded to the skirt **29*a* of the side wall 29. In assembly, the top section 29*b* of the side wall is welded to the top of the slide members while the bottom or skirt section 29*a* of the side wall skirt is permitted to move in the frame within the bending limits of the plate material. The expanded head of each positioning bolt is arranged to seat against the back of the side wall 29 immediately adjacent to the outside edge of the bottom wall 40 of the mold. Once the side wall has been located in assembly, the positioning bolts are tightened down to drive the skirt of the side wall into tight abutting contact against the edge of the bottom wall 40** of the mold.

The bottom wall 40 of the mold is made up of two individual floor panels that include a first fixed panel 70 and a second removable panel 71. The fixed floor panel is rectangular in form, and is preferably integral part of the stationary side wall 28 of the mold. The fixed panel is seated upon the horizontal support beams 39—39 of the stationary frame by means of two parallel legs 72—72 (FIG. 5). A short adjustable beam 75 is slidably secured to each of the support beams 39 so that the top surfaces of the beams 39 and 75 lie within a common horizontal plane. A bolt 76, carried in each support beam 39, passes through a horizontally aligned slotted hole 77 formed in the adjacent adjustable beam 75. The adjustable beam is allowed to slide horizontally beyond the terminal end 79 of the fixed beam towards the adjustable side wall 29 of the mold. In practice, the adjustable beams are brought into close proximity with the side wall 29 and then locked in position by tightening the locking bolts 76—76.

The removable floor panel 71 also contains a pair of legs 80—80 which, in assembly, rest upon the top surface of the adjustable beams as illustrated in FIG. 5. The removable floor panel also includes a lug 81 welded on the underside thereof. The lug protrudes some distance beyond the inside edge 87 of the panel. In assembly, the protruding portion of the lug is slipped beneath the fixed floor panel to align and lock the two panels in assembly. As the skirt of the side wall 29 is driven against the outside edge of the removable floor panel by the positioning bolts, the panel becomes tightly locked together in assembly to close the floor section of the mold.

Figure 7:
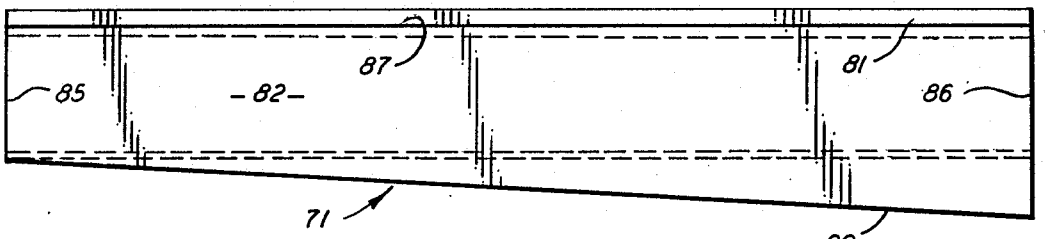
FIGS. 7 and 7*a* illustrate a removable floor panel that forms a section of the bottom wall of the mold.
Figure 7A:
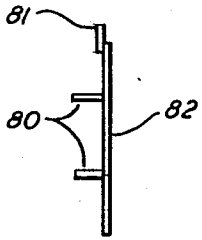
Figure 8:
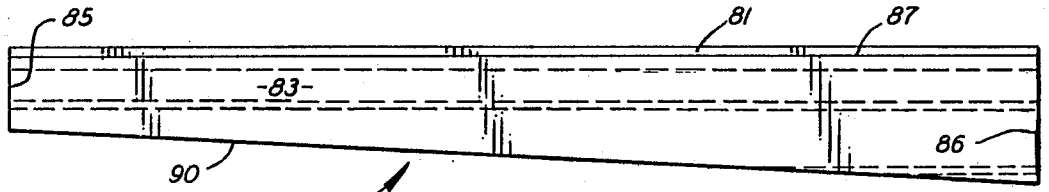
FIGS. 8 and 8*a* illustrate another differently configured removable floor panel suitable for use in the present mold.
Figure 8A:
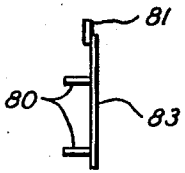
Figure 9:
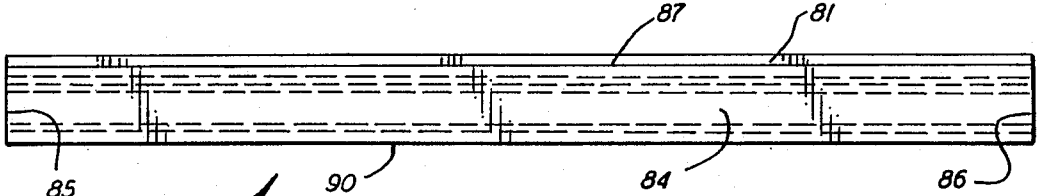
FIGS. 9 and 9*a* further illustrate a third removable floor panel that is also suitable for use in the present mold that has a rectangular configuration.
Figure 9A:
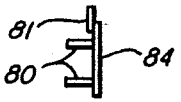

Referring now more specifically to FIGS. 7-9, there is shown a series of removable floor panels 82-84 that are suitable for use in the present fixture. Each panel includes a pair of parallel end surfaces 85 and 86 and one side surface 87 that is perpendicular to the two end surfaces. As shown, the previously noted lug 81 protrudes outwardly from the side surface 87 of each removable floor panel. The opposing side surface 90 of the panel, however, can be made either perpendicular with the end surfaces as illustrated in FIG. 9, or it can be inclined at some desired angle as illustrated in FIGS. 7 and 8. Additionally, the width of the two end surfaces can be varied to change the configuration of a cast section.

To adjust the mold configuration within the fixture, bolts 44 and 50 are first loosened and the movable frame is pulled horizontally away from the fixed frame. A removable floor panel having a desired configuration is then placed upon the adjustable beams 75—75. The adjustable beams are each extended laterally a sufficient distance to permit the legs of the removable panel to be securely seated thereupon. The adjustable beams are then locked in place by tightening down bolts 76—76. With the removable floor panel in place, the adjustable side wall 29 of the mold is vertically positioned in the fixture. Beam 57 is locked in a desired position using bolts 59 and the horizontal arms 55—55 of the bracket 53, which supports the adjustable side wall 29, are seated upon the beam 57 (FIG. 5). The entire movable frame is now moved horizontally within the fixture until the inside surface of the side wall 29 abuts the outside edge surface 90 of the removable floor panel. Bolts 44 and 50 are tightened down to lock the movable frame in this position within the base. The bolts 63—63 are tightened against the back of the adjustable side wall 29 to drive the side wall into tight abutting contact with the outer edge of the removable floor panel.

Figure 1:
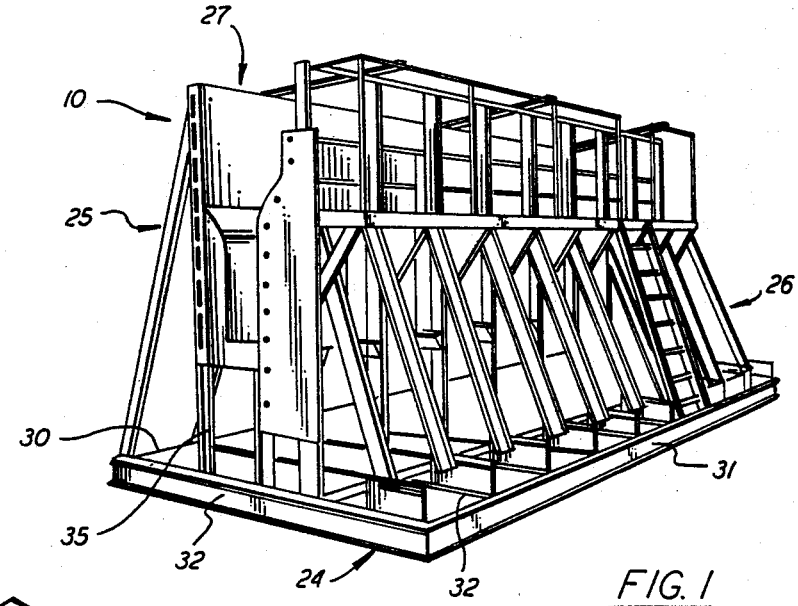
FIG. 1 is a perspective view of a fixture for supporting an adjustable mold that is used to cast concrete median barrier sections.
Figure 6:
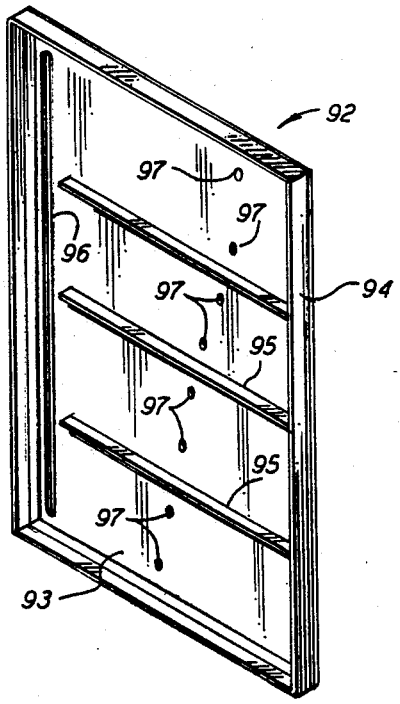
FIG. 6 is an enlarged perspective view of a removable end wall for closing one end of the mold.

The two ends of the mold are closed using end walls 92 of the type illustrated in FIG. 6. The end walls include a flat end plate 93 that is welded to a rectangular frame 94. Stiffening ribs 95—95 are also welded to the back side of the plate to provide additional support and strength to the end wall. An elongated vertically disposed slotted hole 96 is provided along one edge of the end plate and a series of accurately located bolt holes 97—97 are formed within the main body of the plate. In assembly, the slotted hole 96 is aligned over a series of bolt holes 98—98 (FIG. 4) formed in an end plate 99 secured to the fixed frame 25. The end wall is bolted to the fixed frame using suitable bolts (not shown). Bolt holes 97—97 are arranged so that they are aligned with threaded bolt holes 100—100 (FIG. 4) formed in a second end plate 101 mounted in the movable frame. Bolts are passed through the aligned holes 97 and the bolts threaded into holes 100 thereby securing the end wall to the fixture.

Once the mold is closed, reinforcing bars 110 (FIG. 2) are passed across the top of the mold and are locked to the stationary frame 25 and the movable frame 26 by means of locking mechanisms 111 and 112 respectively. The mold is now tightly locked in place and is in a condition to be filled with concrete. The mold will not deform under the weight of the concrete material, and once the barrier section has set, it can be easily removed from the mold cavity by removing the end walls from the fixture, unlocking the reinforcing bars, and moving the movable frame away from the stationary frame.

It should be apparent that the location of the bolt holes 97—97 in the end wall will change depending upon the positioning of the movable frame within the fixture. Accordingly, for each removable floor panel utilized in the fixture, there will be provided a separate set of end walls having the proper bolt hole spacing needed to securely attach the end wall to the fixture. As should now be evident, the present fixture allows the mold cavity to be adjusted to cast either symmetrical or asymmetrical barrier sections having a uniform cross section along its entire length or alternatively a cross section that increases or decreases uniformly along the barrier length.

While this invention has been explained with specific reference to the structure disclosed herein, it is not confined to the details as set forth and this application is intended to cover any modifications and changes as may come within the scope of the following claims.

What is claimed is:

1. A fixture for adjustably supporting a mold of the type used to cast concrete median barrier sections of predetermined length, said fixture including a horizontally disposed base, a vertically disposed stationary frame affixed to said base, a first side wall for said mold that is secured in said stationary frame, a horizontally disposed bottom wall for said mold mounted in said stationary frame, said bottom wall including a fixed panel secured to said frame so that one side edge of said fixed panel abuts the bottom edge of said first side wall, and a removable panel removably mounted in said stationary frame adjacent to the fixed panel so that one side edge of the removable panel abuts the other side edge of the fixed panel to define the floor of the mold, a vertically disposed movable frame slidably mounted in said base, said movable frame being arranged to move toward and away from said first side wall mounted in said stationary frame, a second side wall for said mold that is slidably mounted in said movable frame so that said second side wall can be selectively positioned in a vertical plane said second side wall abutting the other edge of the removable floor panel, and end wall means removably mounted between the two frames to close the ends of said mold.

2. The fixture of claim 1 wherein said end wall means includes a first end wall for closing one end of the mold, and a second end wall for closing the other end of said wall, each of said walls having fastening means for removably securing said end wall to the stationary and movable frames.

3. The fixture of claim 1 wherein said movable frame includes a first series of upright columns that are mounted in said base for individual reciprocal movement toward and away from said stationary frame and bracket slide means for slidably connecting the second side wall of the mold to said vertical columns.

4. The fixture of claim 3 wherein said slide means further includes a second series of upright slide members in sliding contact with said first series of columns and locking means for releasably fastening the first set of columns against said second series of columns whereby the vertical position of the movable wall can be adjusted.

5. The fixture of claim 4 that further includes rest means adjustably secured in said stationary frame for movement in a vertical direction and horizontal support means connected to said second series of columns, said support arms passing under the bottom wall of said mold and being seated upon said rest means.

6. The fixture of claim 1 wherein said removable panel has one side edge that is angularly offset in regard to its other side edge whereby the width of the mold will vary uniformly along its length when the second side wall is placed in abutting contact against said other edge of said removable panel.

7. The fixture of claim 6 that further includes horizontally adjustable beams mounted in the stationary frame beneath the bottom wall of the mold so that said beams can be selectively positioned beneath the removable panel of said floor and means to seat said removable panel upon said adjustable beams.

8. The fixture of claim 1 having positioning hold means acting on the bottom section of the adjustable side wall to press said side wall into tight abutting contact against the other edge of the removable floor panel.

* * * * *